US006595824B2

(12) United States Patent
Calello et al.

(10) Patent No.: US 6,595,824 B2
(45) Date of Patent: Jul. 22, 2003

(54) EDUCATIONAL SNAP-TOGETHER TOY VEHICLE SYSTEM

(76) Inventors: Patrick M. Calello, 52 Harrison Ave., Roseland, NJ (US) 07068; Danilo I. Medina, 185 Clover Hill Dr., Flanders, NJ (US) 07836

( * ) Notice: Subject to any disclaimer, the term of this patent is extended or adjusted under 35 U.S.C. 154(b) by 0 days.

(21) Appl. No.: 10/208,582

(22) Filed: Jul. 30, 2002

(65) Prior Publication Data

US 2003/0054726 A1 Mar. 20, 2003

Related U.S. Application Data

(60) Provisional application No. 60/308,722, filed on Jul. 30, 2001.

(51) Int. Cl.[7] ..... A63H 17/00
(52) U.S. Cl. ..... 446/94; 446/93; 446/95
(58) Field of Search ..... 446/93, 94, 95, 446/465, 470; 403/364, 361, 286, 292, 294, 326, 329

(56) References Cited

U.S. PATENT DOCUMENTS

| | | | | |
|---|---|---|---|---|
| 1,845,201 A | * | 2/1932 | Shepard | 446/93 |
| 2,617,654 A | * | 11/1952 | Nolan et al. | 273/156 |
| 3,611,618 A | * | 10/1971 | Steiner | 446/95 |
| 3,986,293 A | * | 10/1976 | Rieur | 446/75 |
| 3,996,692 A | * | 12/1976 | Daenen | 446/94 |
| 4,680,018 A | * | 7/1987 | Ohno | 446/376 |
| 4,744,780 A | | 5/1988 | Volpe | |
| 4,804,349 A | * | 2/1989 | Loscalzo et al. | 446/93 |
| 4,813,903 A | * | 3/1989 | Furukawa et al. | 446/90 |
| 4,986,789 A | * | 1/1991 | Hang | 446/93 |
| 4,993,983 A | * | 2/1991 | Kurita et al. | 446/94 |
| 5,022,885 A | * | 6/1991 | Lyman | 446/95 |
| 5,046,981 A | * | 9/1991 | Roddy | 446/94 |
| 5,486,127 A | | 1/1996 | Wolfe | |
| 5,564,962 A | | 10/1996 | Navarrete Espinosa | |
| 5,653,621 A | | 8/1997 | Yao | |
| 5,797,784 A | | 8/1998 | Wolfe | |

FOREIGN PATENT DOCUMENTS

GB 2135591 A * 9/1984 ..... A63H/17/00

* cited by examiner

*Primary Examiner*—Derris H. Banks
*Assistant Examiner*—Urszula M Cegielnik
(74) *Attorney, Agent, or Firm*—McCarter & English, LLP; Allen N. Friedman, Esq.; Christine Johnson, Esq.

(57) ABSTRACT

The disclosed educational snap-together toy vehicle system is exemplified in this application as a set of cars and trucks. The vehicles are broken down into four primary components: a main body, front clip, rear clip, and roof. The body parts are snapped together by a contrasting color, plastic three-element connector system consisting of: a fixed universal socket; an intermediate shaped-socket coupler; and a fixed shaped socket.

6 Claims, 5 Drawing Sheets

EDUCATIONAL SNAP-TOGETHER TOY VEHICLE SYSTEM

PRIORITY

This application depends for priority on U.S. Provisional Application Ser. No. 60/308,722, filed Jul. 30, 2001.

BACKGROUND OF THE INVENTION

1. Field of the Invention

This invention is in the field of educational toys.

2. Brief Description of the Background Art

There presently exist many toys that snap together to form either a predetermined model shape or a shape coming from the mind of the child using the toy. Exemplary devices of this type are disclosed in the following U.S. Pat. Nos. 4,744,780, 5,797,784, 5,486,127, and 5,653,621. These all help educate the child in many ways, largely in development of small motor skills. However there is a continuing quest for educational tools that develop a child's higher mental skills.

SUMMARY OF THE INVENTION

The disclosed educational snap-together toy vehicle system is exemplified in this application as a set of cars and trucks. It is aimed at teaching children manipulation and organizational skills using vehicles as a motivating tool and using colors and shapes to teach manipulation and organization.

This toy system is an innovative, expandable and stylish product line consisting of modular transportation toys that allows any child to become an automotive designer. Simplistic representation of automotive product categories rendered in wood, provide the framework for this building system. Bearing an upscale image, futuristic automotive styling and the juxtaposition of traditional wood with modem polymers, the system pushes the design envelope while simultaneously evoking fond memories of the past creating a look that is decidedly "future-retro".

While delivering on sophisticated design innovation, this toy system provides significant consumer benefits and added value by:

- Encouraging and promoting creative thinking
- Inviting fantasy play
- Helping children recognize and group shapes and objects
- Developing and honing motor skills
- Allowing children to develop color matching and shape differentiation skills
- Permitting children to be creative in three dimensions
- Developing problem solving skills
- Teaching children how things work (come apart/go together)

The disclosed exemplary system consists of three vehicles, a sports car, a sedan and a pick-up truck. The vehicles are broken down into four primary components: a main body, front clip, rear clip, and roof. Each vehicle shares the main body. The pieces are snapped together by means of a novel three-piece coupler system. This is the basis for the building system. The roof, front and rear clips are distinct on each vehicle and are interchangeable. By mixing and matching the vehicle components, any child can become an automotive designer.

DETAILED DESCRIPTION OF THE INVENTION

In this exemplary system the main body elements 6, 7, 8, 12 are uniform in color, for example natural wood color. The body parts are snapped together by a contrasting color, plastic three-element connector system consisting of:

1. a fixed universal socket 1;
2. an intermediate shaped-socket coupler 2; and
3. a fixed shaped socket 4.

For each vehicle the plastic parts are the same color. From vehicle to vehicle the plastic parts differ in color. For example, all plastic parts of the sports car may be red. All plastic parts of the sedan may be blue. And all plastic parts of the pick-up truck may be yellow. The child can create other vehicles by snapping together parts of the basic vehicles, but can reassemble the basic vehicle by color matching.

Figure 1:
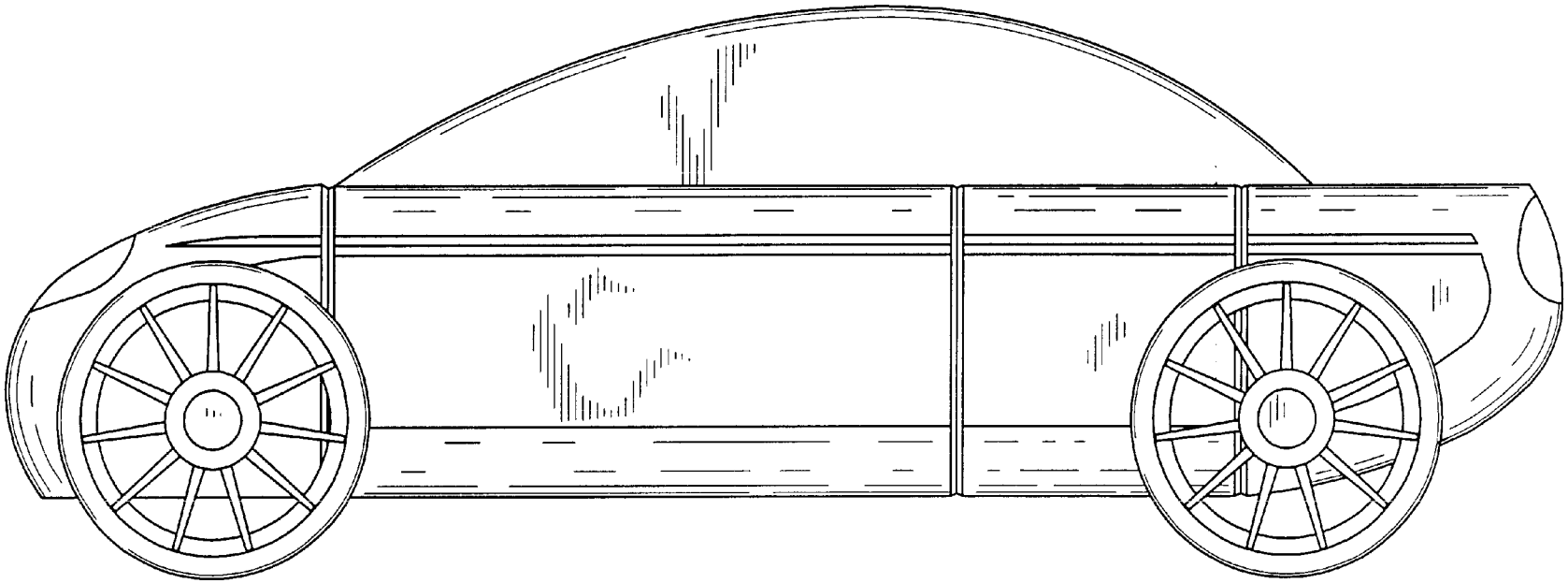
FIG. 1 is a side view of an exemplary toy vehicle of the invention.
Figure 2:
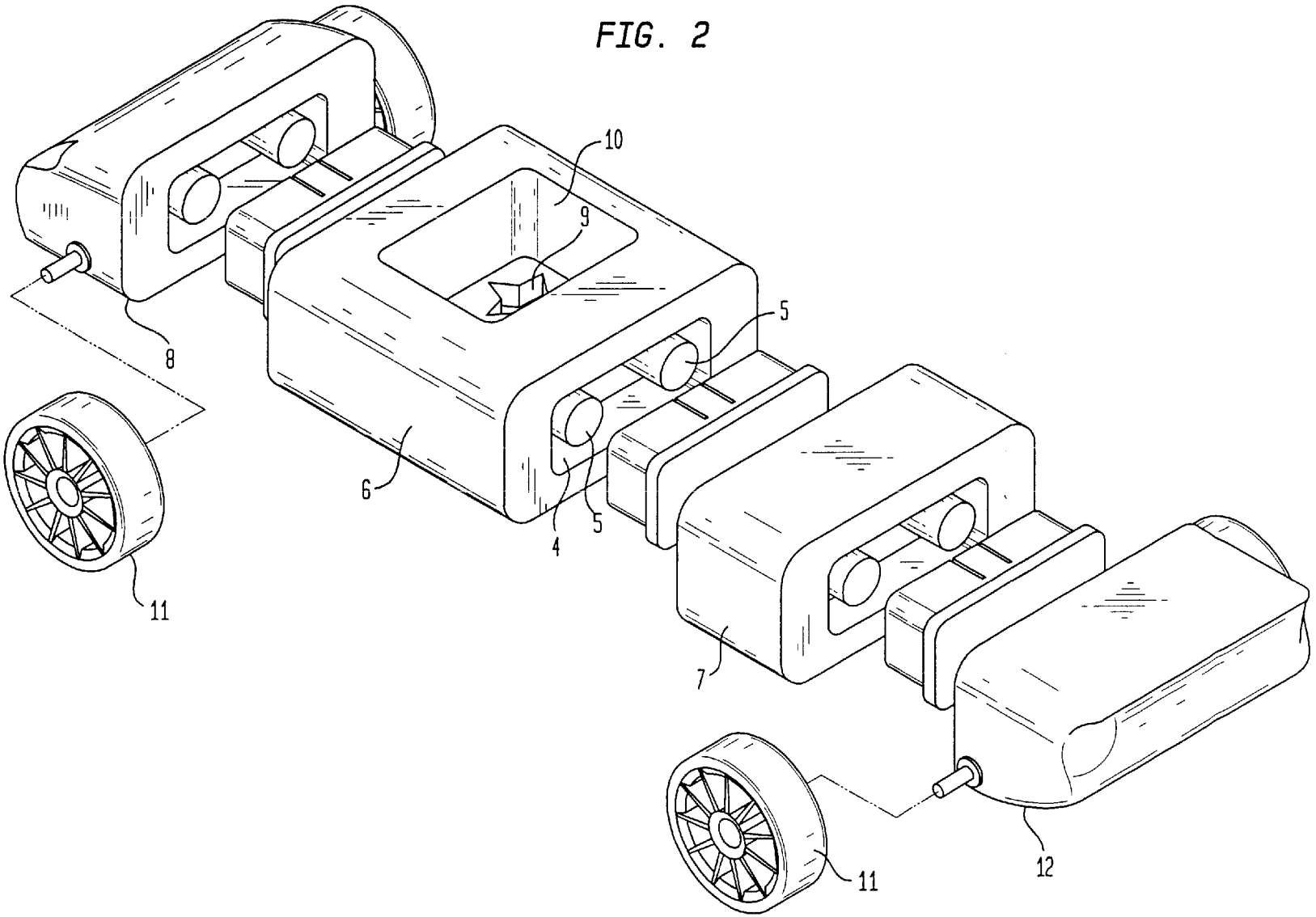
FIG. 2 is an exploded rear side view, in perspective, of an exemplary toy vehicle of the invention.
Figure 3:
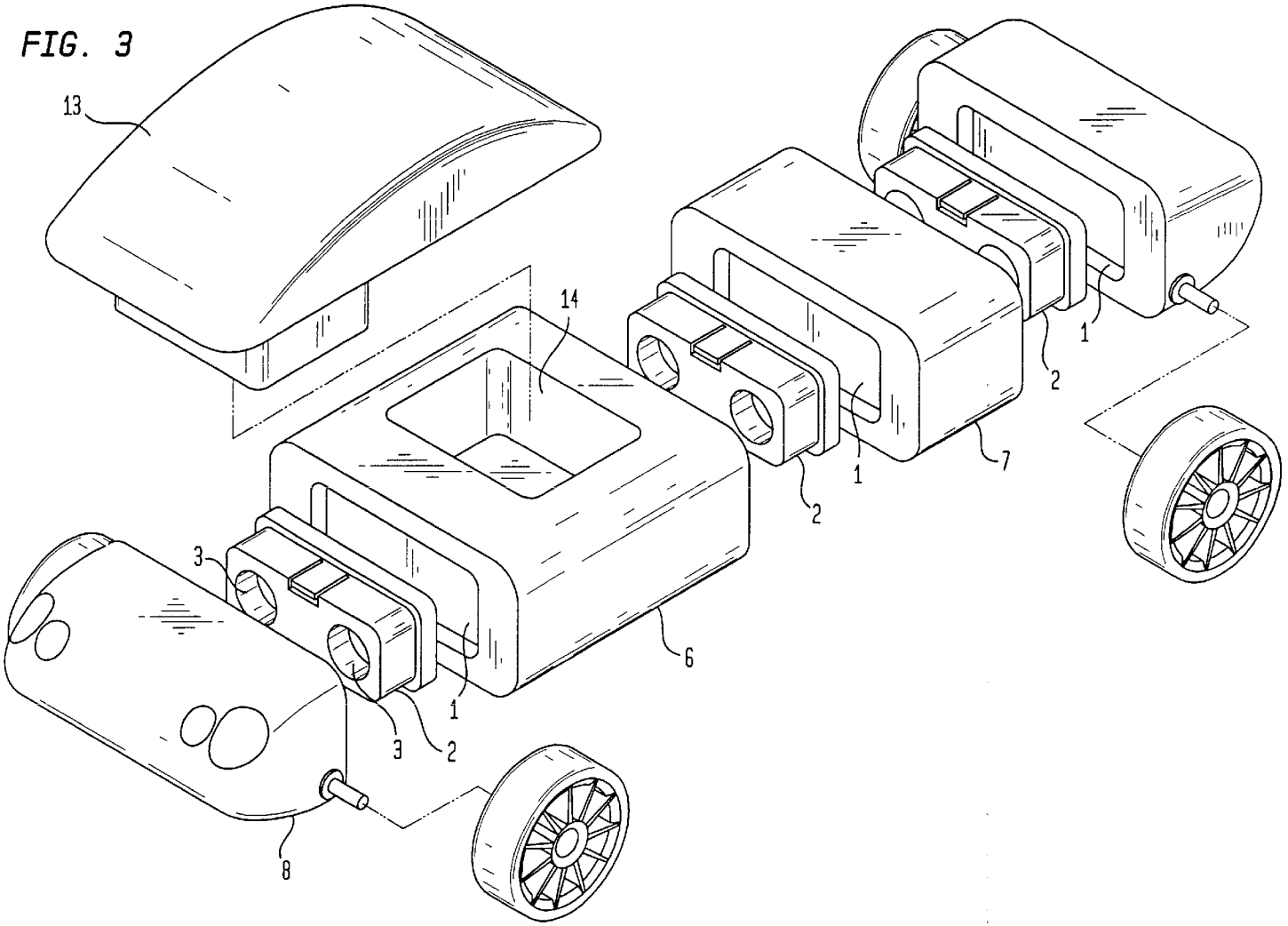
FIG. 3 is an exploded front side view, in perspective, of an exemplary toy vehicle of the invention.

FIG. 3 shows the fixed universal socket (1) and the intermediate shaped socket coupler (2). This exemplary shaped socket coupler has two circular sockets (3). The mating fixed shaped socket (4), shown in FIG. 2, has two circular projections (5) that mate with the circular sockets (3) of the shaped socket coupler. Alternate socket shapes may be, for example, square, triangular, or star shaped and dimensioned such that one shape of projection will not fit into a different shape of socket.

As can be seen in FIGS. 2 and 3, the main body part (6) and the additional intermediate body part (7) have a universal socket (1) fixed in the forward side and a shaped socket (4) fixed in the rearward side. All intermediate shaped-socket couplers will fit into each fixed universal socket.

Each three-element connector system of a different color has a differently shaped socket and projection. For example, the sport coupe, with red plastic parts, may have square sockets and projections, while the sedan, with blue plastic parts, may have circular sockets and projections. Thus, a child snapping off the front end of a sport coupe can not snap it onto a main body section of a sedan, without also removing the sedan's intermediate shaped socket coupler and replacing it with the sport coupe's intermediate shaped socket coupler by fitting it into the sedan's fixed universal socket. Manipulation of the colors and shapes develops the child's color sense and shape awareness.

Further, color and shape awareness may be developed by providing color coded male and female passenger figures with shaped bases mating with shaped sockets (9) located in a depression (10) in the main body (6). Snap-off wheels (11) give further opportunity for color matching.

The roof (14) engages a depression (14) in the main body part (6). Preferably, the roof of each vehicle is shaped to engage the corresponding depression in each main body part.

Figure 4:
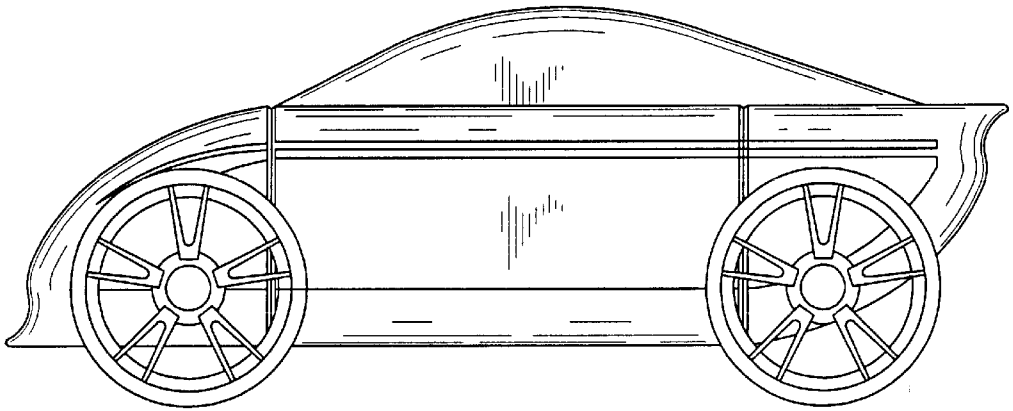
FIG. 4 is a side view of a second exemplary toy vehicle of the invention.
Figure 5:
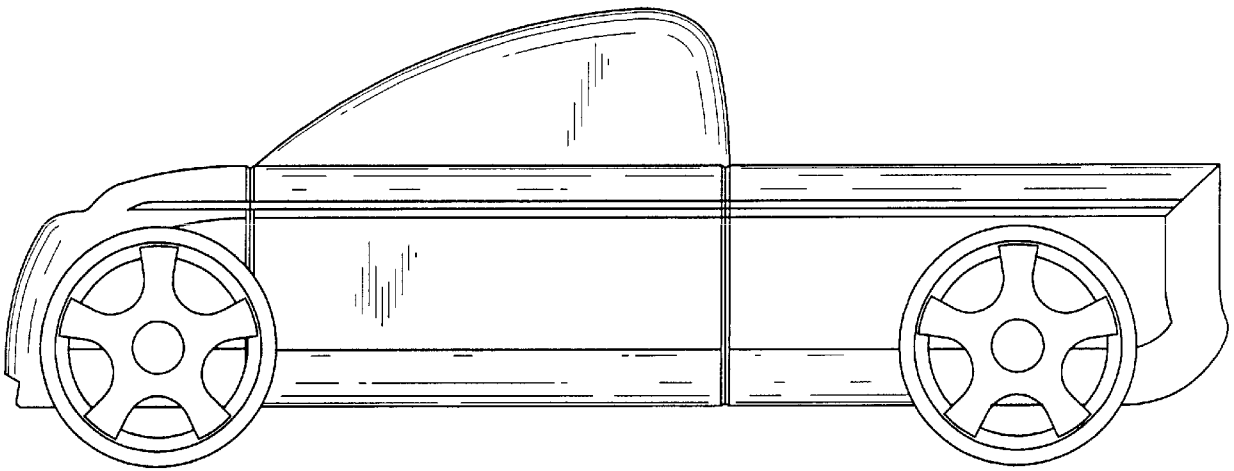
FIG. 5 is a side view of a third exemplary toy vehicle of the invention.
Figure 6:
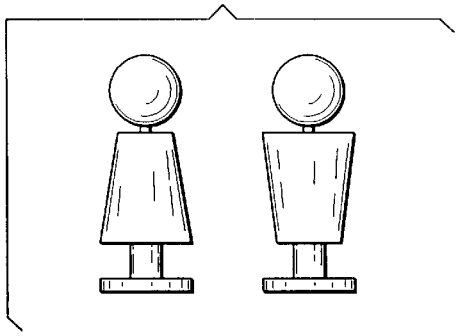
FIG. 6 is an elevational view of exemplary male and female figures.
Figure 7:
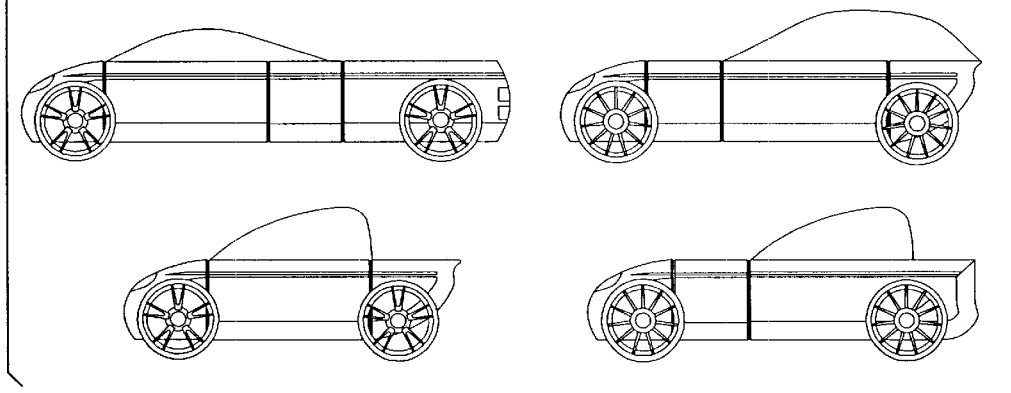
FIG. 7 is an elevational view of four vehicles composed of four different combinations of the basic component elements.
Figure 8:
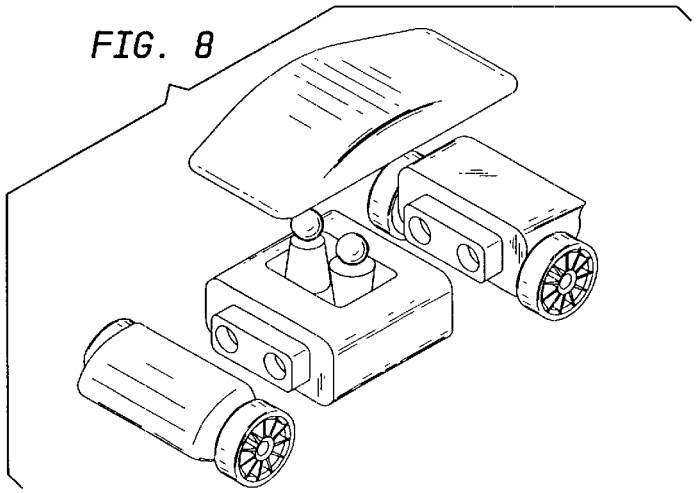
FIG. 8 is an exploded view of an exemplary vehicle showing passengers.

FIG. 4 shows an assembled sport coupe and FIG. 5 shows an assembled pick-up truck. FIG. 6 shows exemplary male and female passenger figures. FIG. 7 shows several composite vehicles, created by snapping together different parts of the basic vehicles. FIG. 8 shows an exploded view of a sport coupe, with passengers.

What is claimed is:

1. A toy vehicle system consisting essentially of a plurality of segmented toy vehicles comprising at least a first vehicle and a second vehicle, wherein the first vehicle comprises a plurality of serially connected body parts, each pair of body parts connected to one another by a three-element connector system, the connector system consisting of;

a) a fixed universal socket;

b) an intermediate shaped-socket coupler having a universal end adapted to engage the universal socket and a shaped end having a first shaped intermediate member defining a first shape; and c) a fixed shaped socket having a first shaped fixed member adapted to engage the first shaped intermediate member, the first connector system being identified by a first color, and wherein the second vehicle comprises a plurality of serially connected body parts, each pair of body parts connected to one another by a three-element connector system, the connector system consisting of;

a) a fixed universal socket;

b) an intermediate shaped-socket coupler having a universal end adapted to engage the universal socket and a shaped end having a second shaped intermediate member defining a second shape; and c) a fixed shape socket having a second shaped fixed member adapted to engage the second shaped intermediate member, the second connector system being identified by a second color, wherein the first shape is different from the second shape such that the first intermediate shaped socket coupler will not engage the second fixed shaped socket and the second intermediate shaped socket coupler will not engage the first fixed shaped socket; and wherein the first color is different from the second color.

2. A system of claim 1 in which the first shaped intermediate member and the second shaped intermediate member are female members and, further, the first shaped fixed member and the second shaped fixed member are male members.

3. A system of claim 1 in which the first vehicle and the second vehicle each comprise a front end, a rear end and at least one body part.

4. A system of claim 3 in which each front end and each rear end comprises axle means for engaging a pair of wheels.

5. A system of claim 4 in which the first vehicle's wheels are coordinated to the first color and the second vehicle's wheels are coordinated to the second color.

6. A system of claim 3 in which the body part of each vehicle defines a depression and the first vehicle further comprises a roof adapted to engage the depression in the body part of each vehicle.

* * * * *